United States Patent [19]

Kopko

[11] Patent Number: 4,537,495

[45] Date of Patent: Aug. 27, 1985

[54] MULTISPEED DEVELOPMENT SYSTEM

[75] Inventor: John J. Kopko, Macedon, N.Y.

[73] Assignee: Zerox Corporation, Stamford, Conn.

[21] Appl. No.: 510,123

[22] Filed: Jul. 1, 1983

[51] Int. Cl.[3] ..... G03G 15/00

[52] U.S. Cl. ..... 355/3 DD; 355/14 D; 430/122

[58] Field of Search ..... 355/3 DD, 14 D; 430/99, 430/120, 122, 126

[56] References Cited

U.S. PATENT DOCUMENTS

| | | | |
|---|---|---|---|
| 3,659,556 | 5/1972 | Mutschler | 118/691 |
| 4,013,041 | 3/1977 | Armstrong et al. | 118/656 |
| 4,084,899 | 4/1978 | Ishida et al. | 355/14 |
| 4,239,374 | 12/1980 | Tatsumi et al. | 355/14 E |
| 4,347,298 | 8/1982 | Kroll et al. | 430/97 |
| 4,371,251 | 2/1983 | Morse | 355/3 TR |
| 4,398,817 | 8/1983 | Nishimura et al. | 355/4 |

*Primary Examiner*—A. T. Grimley
*Assistant Examiner*—David Warren
*Attorney, Agent, or Firm*—H. Fleischer; J. E. Beck; R. Zibelli

[57] ABSTRACT

An apparatus in which a developer roller transports developer material into contact with a photoconductive surface having either a continuous tone or a half-tone latent image recorded thereon. The speed of the developer roller is controlled so that it rotates at a higher speed when developing the continuous tone latent image than when developing the half-tone latent image. In this way, development is optimized for the continuous tone and half-tone latent images so as to produce high quality copies.

12 Claims, 4 Drawing Figures

MULTISPEED DEVELOPMENT SYSTEM

This invention relates generally to an electrophotographic printing machine, and more particularly concerns an apparatus for optimizing development of continuous tone and half-tone latent images.

Generally, an electrophotographic printing machine includes a photoconductive member which is charged to a substantially uniform potential to sensitize the surface thereof. A charged portion of the photoconductive surface is exposed to a light image of an original document being reproduced. This records an electrostatic latent image on the photoconductive member corresponding to the informational areas contained within the original document. After the electrostatic latent image is recorded on the photoconductive member, the latent image is developed by bringing a developer material into contact therewith. The developer material frequently comprises a mixture of carrier granules and toner particles. The toner particles adhere triboelectrically to the carrier granules. During development, the toner particles are attracted from the carrier granules to the latent image forming a toner powder image on the photoconductive member. The toner powder image is subsequently transferred to a copy sheet. Finally, the toner powder image is heated to permanently affix it to the copy sheet in image configuration.

In an electrophotographic printing machine, the original document being reproduced may either be a continuous tone or a half-tone document. For example, if the original document is a picture, it is a half-tone document, whereas if the original document is a sheet containing text thereon, it is a continuous tone document. Hereinbefore, when changing from half-tone reproduction to continuous tone reproduction, the developer bias levels may be changed or the charging levels on the photoconductive surface and/or exposure levels modified to adjust the image development potential suitably. However, changes of this type can also have an adverse effect by increasing the background on the resultant copy to unacceptable levels. Thus, it would be highly desirable to adjust the printing machine to optimize reproduction of continuous tone and half-tone original documents without affecting the background of the copy.

Various approaches have been devised to improve development. The following disclosures appear to be relevant:

U.S. Pat. No. 3,659,556, Patentee: Mutschler, Issued: May 2, 1972.

U.S. Pat. No. 4,084,899, Patentee: Ishida et al., Issued: Apr. 18, 1978.

U.S. Pat. No. 4,347,298, Patentee: Kroll et al., Issued: Aug. 31, 1982.

The relevant portions of the foregoing disclosures may be briefly summarized as follows:

Mutschler dicloses a system in which the rotation speed of a drum disposed in the aperture of a toner container is programmable. The drum speed may be programmed to increase the toner supply which is ultimately applied to the photoconductive surface to develop the latent image recorded thereon.

Ishida et al. discloses an electrophotographic printing machine in which a photoconductive drum is rotated at first speed for exposure and development of the first toner powder image and thereafter at a second, higher speed for development of the subsequent toner images.

A magnetic brush developer roller rotates at a third speed when the drum is rotated at a first speed and a fourth speed, higher than the third speed, when the drum is rotated at the second speed.

Kroll et al. teaches a development system employing two magnetic brush developer rollers. The developer rollers rotate in opposite directions at different angular velocities.

In accordance with the features of the present invention, there is provided an apparatus for developing continuous tone and half-tone latent images recorded on a member. Means, positioned closely adjacent to the member defining a development zone therebetween, transport developer material into contact with the member in the development zone so as to develop the latent image recorded thereon. Means are provided for controlling the speed of the transporting means so that the transporting means moves at a higher speed when developing continuous tone latent images than when developing half-tone latent images.

Pursuant to another aspect of the features of the present invention, there is provided an electrophotographic printing machine having continuous tone and half-tone electrostatic latent images recorded on a photoconductive member. Means, positioned closely adjacent to the photoconductive member defining a development zone therebetween, transport developer material into contact with the photoconductive member in the development zone so as to develop the latent image recorded thereon. Means control the speed of the transporting means so that the transporting means moves at a higher speed when developing continuous tone latent images than when developing half-tone latent images.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
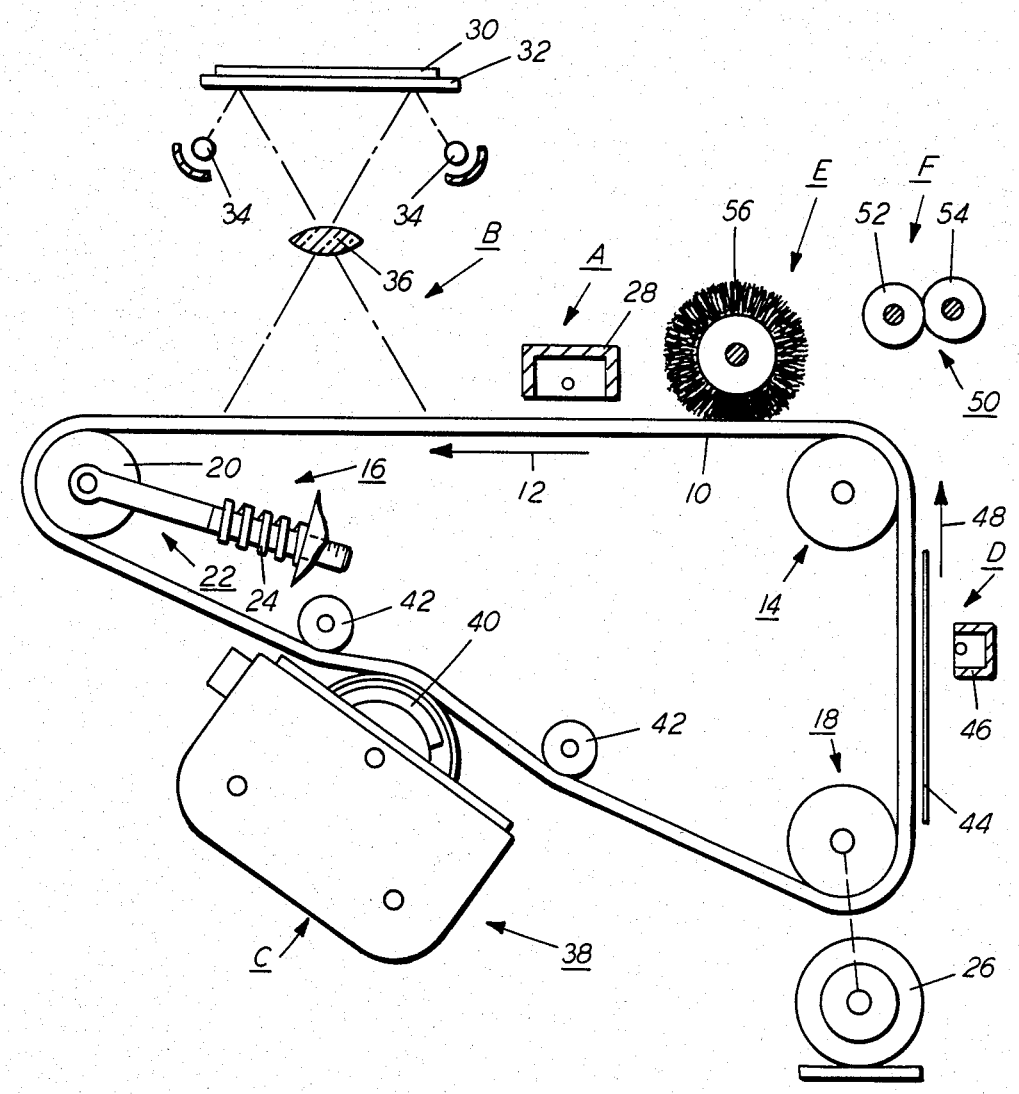
FIG. 1 is a schematic elevational view depicting an electrophotographic printing machine incorporating the features of the present invention therein.

For a general understanding of the illustrative electrophotographic printing machine incorporating the features of the present invention therein, reference is made to the drawing. In the drawings, like reference numerals have been used throughout to designate identical elements. FIG. 1 schematically depicts the various components of an electrophotographic printing machine employing the development system of the present invention therein. Although this development system is particularly well adapted for use in the illustrative electrophotographic printing machine, it will become evident from the following discussion that it is equally well suited for use in a wide variety of electrostatographic printing machines and is not necessarily limited in its application to the paricular embodiment shown herein.

Inasmuch as the art of electrophotographic printing is well known, the various processing stations employed in the FIG. 1 printing machine will be shown hereinafter schematically, and their operation described briefly with reference thereto.

As shown in FIG. 1, the electrophotographic printing machine employs a belt 10 having a photoconductive surface deposited on a conductive substrate. Preferably, the photoconductive surface is made from a selenium alloy with the conductive substrate being made from aluminum which is electrically grounded. Belt 10 moves in the direction of arrow 12 to advance successive portions of the photoconductive surface sequentially through the various processing stations disposed about the path of movement thereof. The path of movement of belt 10 is defined by stripping roller 14, tensioning system 16 and drive roller 18. Tensioning system 16 includes a roller 20 over which belt 10 moves. Roller 20 is mounted rotatably in yoke 22. Spring 24, which is initially compressed, resiliently urges yoke 22 in a direction such that roller 20 presses against belt 10. The level of tension is relatively low permitting belt 10 to be easily deflected. The detailed structure of the tensioning system will be described hereinafter with reference to FIG. 2. With continued reference to FIG. 1, drive roller 18 is mounted rotatably and in engagement with belt 10. Motor 26 rotates roller 18 to advance belt 10 in the direction of arrow 12. Roller 18 is coupled to motor 26 by suitable means such as a belt drive. Stripping roller 14 is freely rotatable so as to permit belt 10 to move in the direction of arrow 12 with a minimum of friction.

Initially, a portion of belt 10 passes through charging station A. At charging station A, a corona generating device, indicated generally by the reference numeral 28, charges the photoconductive surface of belt 10 to a relatively high, substantially uniform potential.

Next, the charged portion of the photoconductive surface is advanced through exposure station B. At exposure station B, an original document 30 is positioned facedown upon transparent platen 32. Lamps 34 flash light rays onto original document 30. The light rays reflected from original document 30 are transmitted through lens 36 forming a light image thereof. Lens 36 focuses the light image onto the charged portion of the photoconductive surface to selectively dissipate the charge thereon. This records an electrostatic latent image on the photoconductive surface which corresponds to the informational areas contained within original document 30. One skilled in the art will appreciate that an optical system of the foregoing type may be replaced by a modulated energy beam such as a laser beam. For example, computer generated information may be employed to modulate a laser beam to record the desired information on the charged photoconductive surface.

After the electrostatic latent image has been recorded on the photoconductive surface of belt 10, belt 10 advances the latent image to development station C. At development station C, a magnetic brush development system, indicated generally by the reference numeral 38, advances an insulating developer material into contact with the electrostatic latent image. Preferably, magnetic brush development system 38 includes a developer roller 40. Developer roller 40 transports a brush of developer material comprising magnetic carrier granules and toner particles into contact with belt 10. Preferably, developer roller 40 is positioned such that the brush of developer material deforms belt 10 between idler rollers 42 in an arc with belt 10 conforming, at least partially, to the configuration of the developer material. In this way, belt 10 wraps around developer roller 40 to form an extended development zone. Developer roller 40 rotates at a variable speed dependent upon the type of original document being reproduced. When the original document is a continuous tone document, developer roller 40 rotates at a higher angular velocity than when the original document is a half-tone. Thus, the operator depresses the appropriate button corresponding to whether the original document is a half-tone or a continuous tone document to regulate the power energizing the motor driving developer roller 40 so as to rotate developer roller 40 at the appropriate speed corresponding to the type of document being reproduced. The foregoing will be discussed in greater detail with reference to FIG. 4.

With continued reference to FIG. 1, after development, belt 10 advances the toner powder image to transfer station D. At transfer station D, a sheet of support material 44 is moved into contact with the toner powder image. Sheet of support material 44 is advanced to transfer station D by a sheet feeding apparatus (not shown). Preferably, the sheet feeding apparatus includes a feed roll contacting the uppermost sheet of a stack of sheets. The feed roll rotates so as to advance the uppermost sheet from the stack into the chute. The chute directs the advancing sheet of support material into contact with the photoconductive surface of belt 10 in a timed sequence so that the toner powder image developed thereon contacts the advancing sheet of support material at transfer station D.

Transfer station D includes a corona generating device 46 which sprays ions onto the back side of sheet 44. This attracts the toner powder image from the photoconductive surface to sheet 44. After transfer, sheet 44 moves in the direction of arrow 48 onto a conveyor (not shown) which advances sheet 44 to fusing station E.

Fusing station E includes a fuser assembly, indicated generally by the reference numeral 50, which permanently affixes the transfered toner powder image to sheet 44. Preferably, fuser assembly 50 includes a heated fuser roller 52 and a back-up roller 54. Sheet 44 passes between fuser roller 52 and back-up roller 54 with the toner powder image contacting fuser roller 52. After fusing, a chute guides the advancing sheet 44 to a catch tray for subsequent removal from the printing machine by the operator.

Invariably, after the sheet of support material is separated from the photoconductive surface of belt 10, some residual particles remain adhering thereto. These residual particles are removed from the photoconductive surface at cleaning station F. Cleaning station F includes a rotatably mounted fibrous brush 56 in contact with the photoconductive surface. The particles are cleaned from the photoconductive surface by the rotation of brush 56. Subsequent to cleaning, a discharge lamp (not shown) floods the photoconductive surface with light to dissipate any residual electrostatic charge remaining thereon prior to the charging thereof for the next successive imaging cycle.

It is believed that the foregoing description is sufficient for purposes of the present application to illustrate the general operation of an electrophotographic printing machine incorporating the features of the present invention therein.

Figure 2:
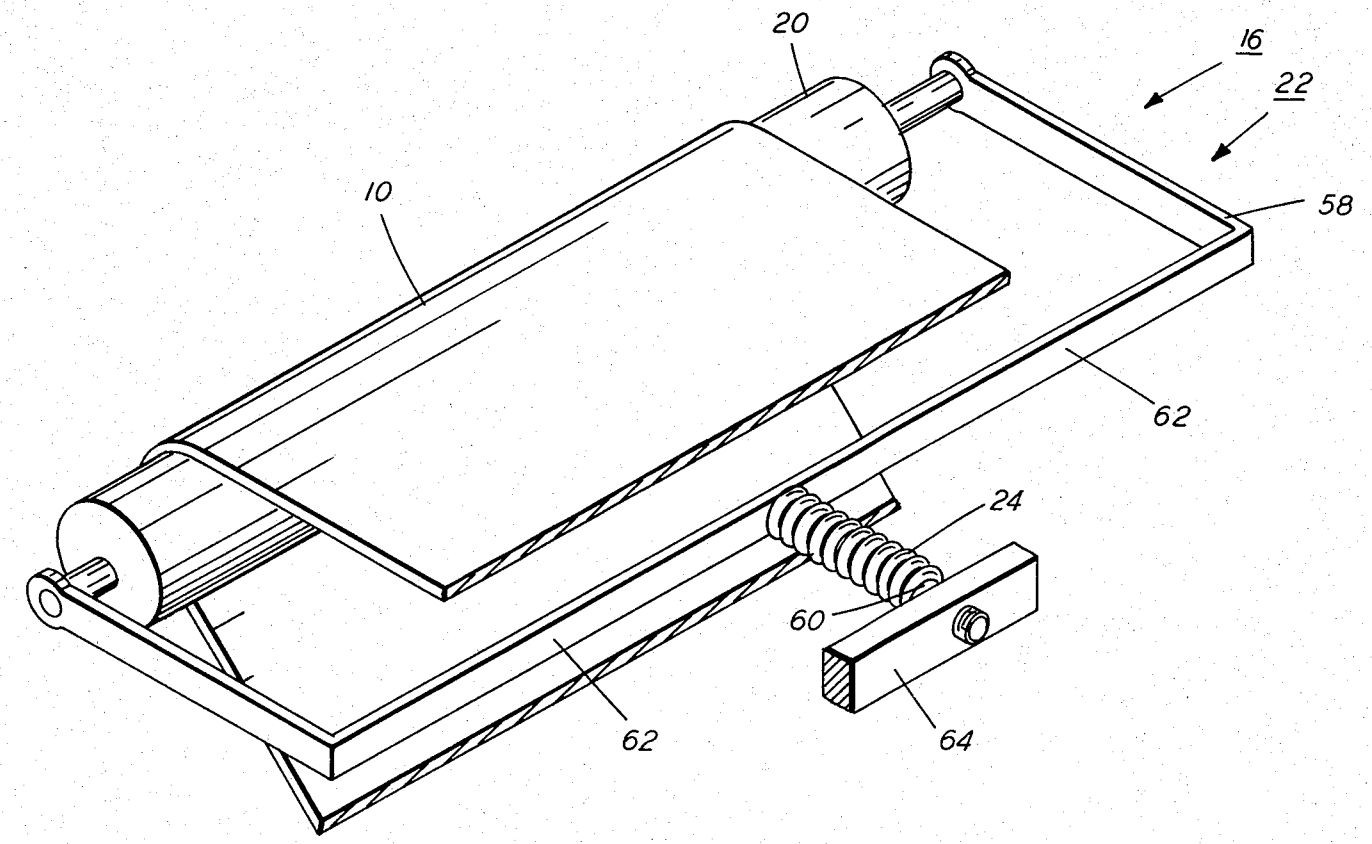
FIG. 2 is a fragmentary, perspective view showing the belt tensioning arrangement for the FIG. 1 printing machine.

Referring now to FIG. 2, there is shown tensioning system 16 in greater detail. As depicted thereat, tensioning system 16 includes roller 20 having belt 10 passing thereover. Roller 20 is mounted in suitable bearings in a yoke, indicated generally by the reference numeral 22. Preferably, yoke 22 includes a U-shaped member 58 supporting roller 20 and a rod 60 secured to the midpoint of cross member 62 of U-shaped member 58. A coil spring 24 is wrapped around rod 60. Rod 60 is mounted slidably in the printing machine frame 64. Spring 24 is compressed between cross member 62 and frame 64. In this way, compressed spring 24 resiliently urges yoke 22 and, in turn, roller 20 against belt 10. Spring 24 is designed to have the appropriate spring constant such that when placed under the desired compression, belt 10 is tensioned to about 0.1 killograms per linear centimeter. Belt 10 is maintained under a sufficiently low tension to enable the developer material on developer roller 40 to wrap belt 10 about developer roller 40 through an arc ranging from about 10° to about 10°.

Figure 3:
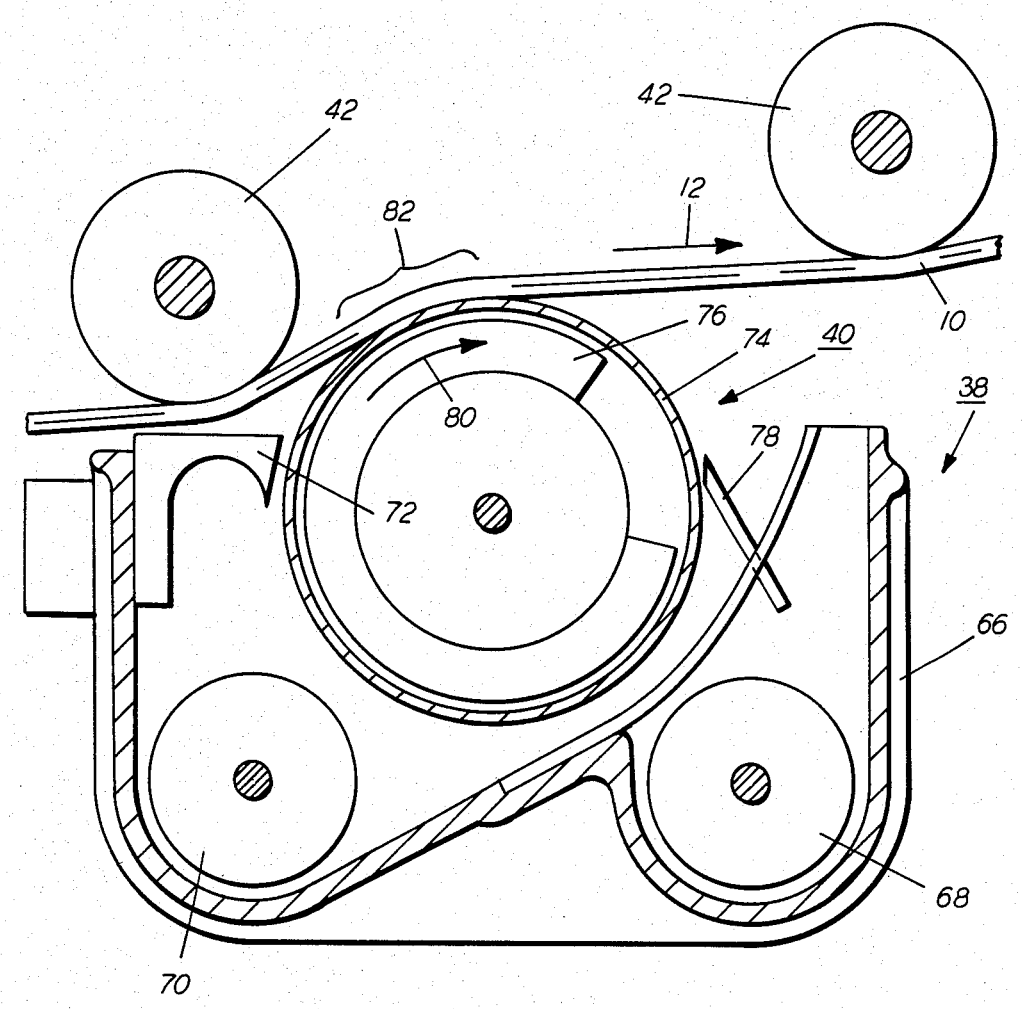
FIG. 3 is an elevational view illustrating the development system used in the FIG. 1 printing machine.

The detailed structure of development system 38 is described in FIG. 3. As shown thereat, development system 38 includes a housing 66 defining a chamber for storing a supply of developer material therein. A pair of augers 68 and 70 mix the developer material in the chamber of housing 66 and advance the developer material to developer roller 40. Developer roller 40 advances the developer material into contact with the electrostatic latent image recorded on photoconductive belt 10. A trim bar 72 regulates the thickness of the developer pile height on developer roller 40. The tangential velocity of developer roller 40 is in the same direction as that of belt 10. Trim bar 72 extends in a longitudinal direction substantially across the width of developer roller 40 to provide a uniform gap controlling the quantity of material being moved into the development zone. Developer roller 40 includes a nonmagnetic tubular member 74 preferably made from aluminum having the exterior circumferential surface thereof roughened. An elongated magnet 76 is positioned concentrically within tubular member 74 and mounted on a shaft. Preferably, magnet 76 extends about 300° with the exit zone being devoid of magnetic material to permit the developer material to fall from tubular member 74 and return to the chamber of housing 66 for subsequent reuse. Blade 78 further assists in scrapping the unused developer material from tubular member 74. Tubular member 74 is coupled to a drive motor which, in turn, rotates tubular member 74 in the direction of arrow 80. The angular velocity of tubular member 74 is adjustable and dependent upon the type of original document being reproduced. Preferably, tubular member 74 is electrically biased by a voltage source (not shown) to a suitable polarity and magnitude. The voltage level is intermediate that of the background voltage level and the image voltage level recorded on the photoconductive surface of belt 10. By way of example, the voltage source electrically biases tubular member 74 to a voltage ranging from about 50 volts to about 300 volts. As tubular member 74 rotates, a brush of developer material is formed on the peripheral surface thereof. The brush of developer material advances into contact with belt 10 in development zone 82 and deflects belt 10 to wrap around developer roller 40 forming an extended development zone. Magnet 76 is mounted stationarily to attract the developer material to tubular member 74 due to the magnetic properties of the carrier granules having the toner particles adhering triboelectrically thereto. In development zone 82, some of the toner particles are attracted from the carrier granules to the latent image to form a toner powder image on the photoconductive surface of belt 10.

Figure 4:
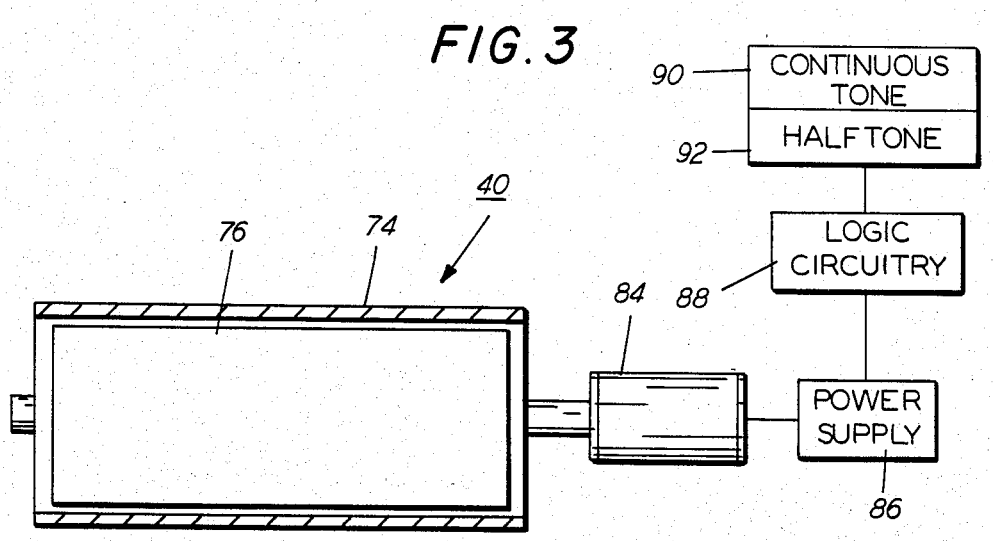
FIG. 4 is an elevational view depicting the developer roller of the FIG. 3 development system.

Turning now to FIG. 4, there is shown developer roller 40 and the control scheme for maintaining the angular velocity thereof at the desired level. As illustrated thereat, magnet 76 is positioned concentrically and stationarily within tubular member 74. Tubular member 74 is coupled to motor 84. Motor 84 is a variable speed motor which rotates tubular member 74 at a selected constant angular velocity. Magnet 76 has the exterior circumferential surface thereof spaced from the interior circumferential surface of tubular member 74. In this way, the magnetic field generated by magnet 76 attracts the developer material to the exterior circumferential surface of tubular member 74. As motor 84 rotates tubular member 74 in the direction of arrow 80 (FIG. 3), the developer material is advanced into development zone 82 (FIG. 3). The advancing developer material contacts belt 10 and deflects belt 10 to wrap around developer roller 40 in an arc. In this way, the spacing between belt 10 and tubular member 74 is controlled by the compressed pile height of the developer material in development zone 82. Powr supply 86 controls the speed at which motor 84 rotates tubular member 74. Logic circuitry 88 controls power supply 86 to regulate the excitation power supplied to motor 84. In operation, the operator depresses button 90, when the original document is a continuous tone original document, or button 92, if it is a half-tone original document. Actuation of the selected button is sensed by logic circuitry 88 which, in turn, controls power supply 86 to regulate the speed at which motor 84 rotates tubular member 74. Thus, if the continuous tone button 90 is depressed by the operator, logic circuitry 88 controls power supply 86 to regulate motor 84 so as to rotate tubular member 74 at a higher angular velocity than when half-tone button 92 is depressed. For example, if half-tone button 92 is depressed, the ratio of the tangential velocity of tubular member 74 to that of belt 10 is about 2. If continuous tone button 90 is depressed, tubular member 74 will rotate at a higher angular velocity and the ratio of the tangential velocity of tubular member 74 to that of belt 10 will be greater than 2. In this way, the angular velocity of tubular member 74 is optimized for the original document being reproduced.

By way of example, the insulating developer material used in the development system preferably has a resistivity ranging from about $10^{14}$ to about $10^{17}$ ohm-centimeters. Toner particles are made preferably from a thermoplastic material with the carrier granules being made preferably from a ferrite coated with a polyamide resin. Other materials, such as polystyrenes, polyesters or ethylene vinyl acetate copolymers may be employed for the coating on the ferrite.

In recapitulation, it is clear that the development apparatus of the present invention includes a developer roller having an adjustable angular velocity to optimize development of continuous tone and half-tone latent images.

It is, therefore, evident that there has been provided in accordance with the present invention an apparatus for developing an electrostatic latent image that optimizes development of continuous tone and half-tone latent images. This apparatus fully satisfies the advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus which develops continuous tone and half-tone latent images recorded on a flexible belt, including:

means, positioned closely adjacent to the flexible belt defining a development zone therebetween, for transporting developer material into contact with the flexible belt in the development zone so as to develop the latent image recorded thereon;

means for maintaining the flexible belt at a preselected tension of sufficient magnitude so that the developer material being transported into contact therewith deflects the flexible belt about said transporting means to form a wrapped development zone; and means for controlling the speed of said transporting means so that said transporting means moves at a higher speed when developing continuous tone latent images than when developing half-tone latent images.

2. An apparatus according to claim 1, further including means for attracting the developer material to said transporting means.

3. An apparatus according to claim 2, wherein said transporting means includes a tubular member journaled for rotary movement.

4. An apparatus according to claim 3, wherein said controlling means includes a variable speed drive motor coupled to said tubular member.

5. An apparatus according to claim 4, wherein said controlling means includes means for regulating the speed of said drive motor.

6. An apparatus according to claim 5, further including means for electrically biasing said tubular member.

7. An electrophotographic printing machine of the type having continuous tone and half-tone electrostatic latent images recorded on a flexible photoconductive belt, wherein the improvement includes:

means, positioned closely adjacent to the photoconductive belt defining a development zone therebetween, for transporting developer material into contact with the photoconductive belt in the development zone so as to develop the latent image recorded thereon;

means for maintaining the flexible photoconductive belt at a preselected tension of sufficient magnitude so that the developer material being transported into contact therewith deflects the flexible photoconductive belt about said transporting means to form a wrapped development zone; and means for controlling the speed of said transporting means so that said transporting means moves at a higher speed when developing continuous tone latent images than when developing half-tone latent images.

8. A printing machine according to claim 7, further including means for attracting the developer material to said transporting means.

9. A printing machine according to claim 8, wherein said transporting means includes a tubular member journaled for rotary movement.

10. A printing machine according to claim 9, wherein said controlling means includes a variable speed drive motor coupled to said tubular member.

11. A printing machine according to claim 10, wherein said controlling means includes means for regulating the speed of said drive motor.

12. A printing machine according to claim 11, further including means for electrically biasing said tubular member.

* * * * *